US005950161A

United States Patent [19]

Kozuma et al.

[11] Patent Number: 5,950,161

[45] Date of Patent: Sep. 7, 1999

[54] NAVIGATION SYSTEM

[75] Inventors: Makoto Kozuma, Onojo; Yuji Mitsunaga, Dazaifu; Keiich Zenmyo, Fukuoka-ken, all of Japan

[73] Assignee: Matsushita Electric Industrial Co., Ltd., Osaka, Japan

[21] Appl. No.: 08/658,134

[22] Filed: Jun. 4, 1996

[30] Foreign Application Priority Data

Jun. 26, 1995 [JP] Japan ..... 7-158998

[51] Int. Cl.[6] ..... G10L 3/00

[52] U.S. Cl. ..... 704/260; 704/270

[58] Field of Search ..... 395/2.69; 704/260, 704/270, 275, 272, 258, 278

[56] References Cited

U.S. PATENT DOCUMENTS

| | | | |
|---|---|---|---|
| 4,685,135 | 8/1987 | Lin et al. | 704/260 |
| 4,783,810 | 11/1988 | Kroon | 704/260 |
| 4,903,212 | 2/1990 | Yokouchi et al. | 701/216 |
| 4,975,957 | 12/1990 | Ichikawa et al. | 704/260 |
| 5,025,261 | 6/1991 | Ohta et al. | 342/357 |
| 5,179,519 | 1/1993 | Adachi et al. | 701/216 |
| 5,274,387 | 12/1993 | Kakihara et al. | 342/451 |
| 5,293,163 | 3/1994 | Kakihara et al. | 340/995 |
| 5,369,588 | 11/1994 | Hayami et al. | 701/216 |
| 5,442,557 | 8/1995 | Kameko | 701/213 |
| 5,473,324 | 12/1995 | Ueno | 340/990 |
| 5,497,372 | 3/1996 | Nankoh et al. | 370/480 |
| 5,555,343 | 9/1996 | Luther | 704/260 |

*Primary Examiner*—Richemond Dorvil
*Attorney, Agent, or Firm*—Stevens, Davis, Miller & Mosher, L.L.P.

[57] ABSTRACT

A multiplexed-information receiving apparatus and a navigation system for converting character information as received into speech information for presentation of the information in a voice. The multiplexed-information receiving apparatus includes a receiver-unit for receiving character-multiplexed information, a demultiplexing unit for demultiplexing the character-multiplexed information received by the receiver unit, a speech synthesizing unit for converting character information outputted from the demultiplexing unit into speech information, and a speech output unit for outputting the speech information in a voice signal.

2 Claims, 9 Drawing Sheets

NAVIGATION SYSTEM

BACKGROUND OF THE INVENTION

The present invention relates to a multiplexed-information receiving apparatus for receiving, for example, FM (Frequency-Modulated) character-multiplexed information in an FM character-multiplexed broadcast and a navigation system incorporating such multiplexed-information receiving apparatus.

For better understanding of the present invention, the technical background thereof will first be reviewed by reference to the accompanying drawings.

FIG. 8 is a block diagram which shows in general a structure or configuration of a conventional multiplexed-information receiving apparatus known heretofore, by taking as an example an FM radio receiver capable of receiving FM (Frequency-Modulated) character-information multiplexed broadcast services.

Referring to FIG. 8, it is assumed that an FM character-multiplexed information signal which can be derived by multiplexing FM character information, FM speech information and the like in a manner known per se is being broadcast by an FM broadcasting station (not shown in FIG. 8). The FM character-multiplexed information signal is received by an FM (frequency modulation) receiver unit 1. Of the FM character-multiplexed information signal as received, the FM speech information signal component is demultiplexed or separatively extracted to be supplied to a speech output unit 4 to be thereby outputted as speech information in a voice.

On the other hand, the FM character information is sent to an FM signal demodulating unit 2 which is designed to process multiplexed character information. More specifically, the FM demodulating unit 2 serves for demultiplexing or separating multiplexed signal components for performing digital processing thereon with a view to extracting character information of concern. The character information derived from the digital processing executed by the FM demodulating unit 2 is outputted to a display unit 5 via a control unit 3 to be displayed in the form of images or pictures.

FIG. 9 is a block diagram showing generally a structure of a conventional navigation system known heretofore. More specifically, this navigation system is so designed as to be capable of receiving road traffic information. As typical ones of such navigation system, there may be mentioned a system known worldwide as the intelligent transport system (hereinafter referred to as the ITS system) and a system which is known in Japan as the vehicle information and communication system (hereinafter referred to as the VIC system) and which may be considered as constituting a part of the ITS system.

Now, referring to FIG. 9, it is assumed that various service information inclusive of road traffic information is broadcast from a transmitter unit 11 of an infra-information unit 10 incorporated in a system such as, for example, the system known as the VIC system. The service information mentioned above may be broadcast from a central station of the VIC system in the form of character-multiplexed information and picture information. In the navigation system under consideration, the service information broadcast from the infra-information center 10 of the VIC system is received by a receiver unit 6 of the navigation system. The service information as received is sent to a navigation unit 7 from the receiver unit 6. The navigation unit 7 is provided with a database destined for storing map information and others and a global positioning system (hereinafter referred to as the GP system) for obtaining position or location information through the medium of electromagnetic waveform received via a GPS satellite to thereby generate information required for the navigation. Of the information generated by the navigation unit 7, speech information is outputted to a speech output unit 8 while other various service information than the position or location information, map information and the speech information is displayed as a picture or an image on a screen of a display unit 9.

In conjunction with the prior art systems of the structures described above, it is however noted that the FM character information of the FM character-multiplexed broadcast and various service information available from the VIC system are visibly generated on a display screen of the display device in the form of characters, graphics or the like. Further, it is noted that the available amount of such information has a trend to increase more and more. Accordingly, attention of a driver or operator driving a motor vehicle equipped with a navigation system compatible with the VIC system, by way of example, is apt to concentrate his or her attention to the display generated on the display unit when he or she desires to acquire an increasing amount of the information, which is of course undesirable from the standpoint for ensuring the security or safety of the driver.

SUMMARY OF THE INVENTION

In the light of the state of the art described above, it is an object of the present invention to provide a multiplexed-information receiving apparatus and a navigation system which can ensure enhanced security or safety of a user such as a driver of a motor vehicle equipped with such apparatus and system upon reception and display of the character and figure information or the like concerning road traffic information.

In view of the above and other objects which will become apparent as the description proceeds, there is provided according to a general aspect of the present invention a multiplexed-information receiving apparatus which includes a receiver unit for receiving character-multiplexed information, a demultiplexing unit for demultiplexing or separating character information from the character-multiplexed information as received by the receiver unit, a speech synthesizing unit for converting the character information outputted from the demultiplexing unit into speech information, and a speech output unit for outputting the speech information in a voice signal.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
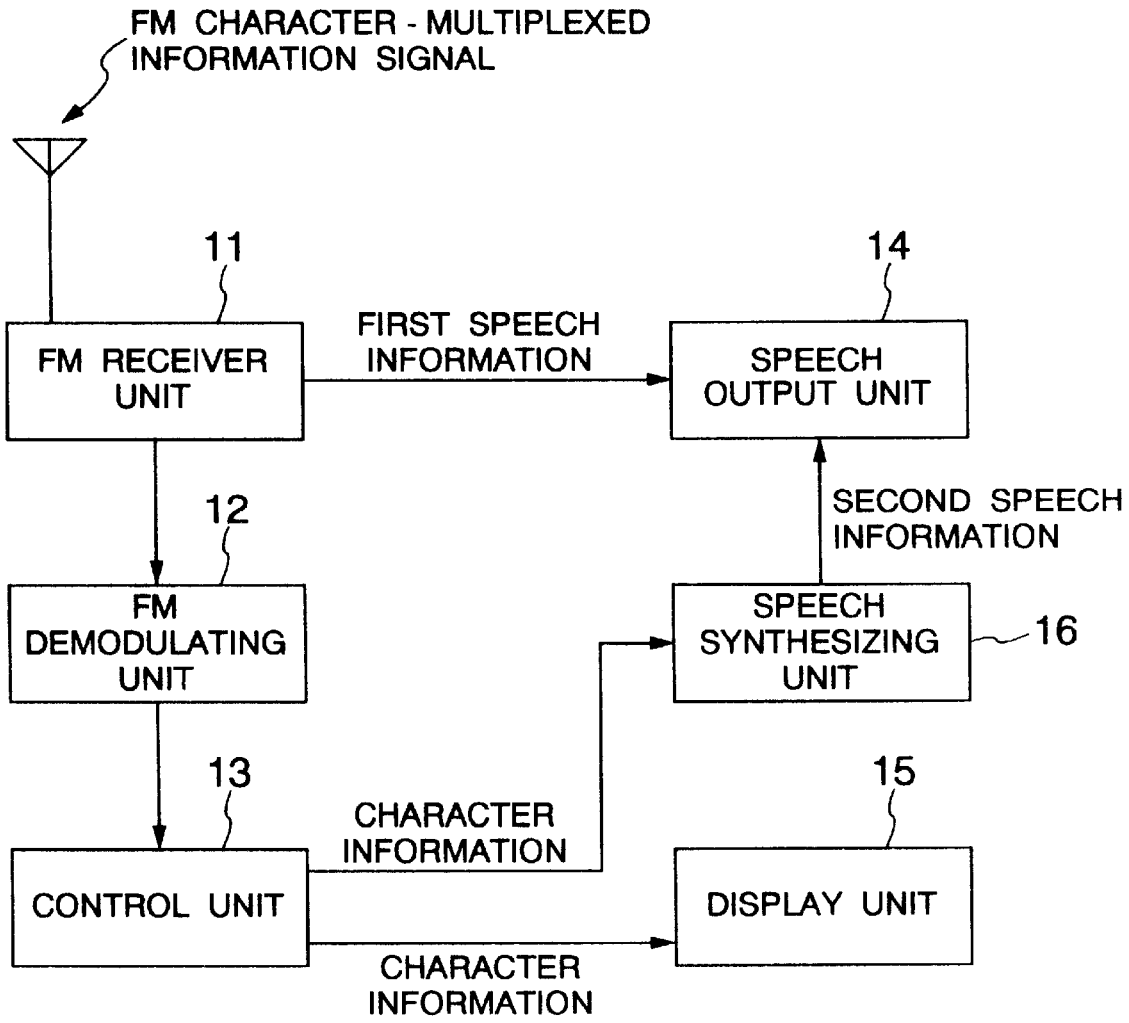
FIG. 1 is a block diagram showing a configuration of a multiplexed-information receiving apparatus according to a first embodiment of the present invention.

Now, the present invention will be described in detail in conjunction with what is presently considered as preferred or typical embodiments thereof by reference to the drawings. In the following description, like reference characters designate like or corresponding parts throughout the several views.

EMBODIMENT 1

FIG. 1 is a block diagram showing generally a circuit configuration of a multiplexed-information receiving apparatus according to a first embodiment of the present invention, by taking as an example thereof an FM radio receiver having a capability of receiving such FM character-multiplexed broadcast signal.

In FIG. 1, reference numeral 11 denotes an FM (frequency-modulated) receiver unit for receiving FM character-multiplexed information signal(s) containing FM speech information, FM character information and the like, 12 denotes an FM (frequency-modulated) demodulating unit designed for extracting the FM character information by demultiplexing or separating the FM character-multiplexed information signal received by the FM receiver unit 11, processing digitally the FM character information as extracted for thereby deriving the FM character information of concern, 13 denotes a control unit for controlling data processing to be performed on the FM character information supplied from the FM demodulating unit 12, numeral 14 denotes a speech output unit for outputting the FM speech information in a voice signal, 15 denotes a display unit for displaying on a screen thereof the FM character information, and the reference numeral 16 denotes a speech synthesizing unit for transforming or converting the FM character information signal into the speech information signal to be outputted in a voice signal.

Next, description will be directed to operation of the multiplexed-information signal receiving apparatus having the structure implemented as mentioned above.

It is assumed that FM character-multiplexed information is being sent out from an FM broadcast station (not shown), as is illustrated in FIG. 1. In the multiplexed-information receiving apparatus, the FM character-multiplexed information is received by the FM receiver unit 11 via an antenna. Of the FM character-multiplexed information as received by the FM receiver unit 11, FM speech information is sent as first speech information to the speech output unit 14 to be outputted in a voice signal.

On the other hand, the FM character-multiplexed information is supplied to the FM demodulating unit 12 which processes the multiplexed FM character information. More specifically, the FM demodulating unit 12 demultiplexes the FM character-multiplexed information signal and performs digital processing on that signal to thereby derive the FM character information signal of concern. The FM character information signal is then outputted through the control unit 13 to the display unit 15 to be displayed thereon and at the same time sent to the speech synthesizing unit 16. The FM character information signal inputted to the speech synthesizing unit 16 is transmitted or converted into second speech information to be outputted from the speech output unit 14 in a voice signal.

As can be seen from the above, in the multiplexed-information receiving apparatus according to the first embodiment of the invention, the FM character information contained in the FM character-multiplexed information signal is not only displayed in the form of a picture on the display unit 15 but also outputted in a voice signal after having been converted into the speech information. Thus, in the case where the multiplexed-information receiving apparatus is incorporated, for example, in a navigation system for a motor vehicle, a driver or operator thereof can aurally understand the content of the FM character information without his or her attention being attracted limitedly to the information displayed on the display unit 15, whereby danger the driver might otherwise experience can be avoided.

EMBODIMENT 2

Figure 2:
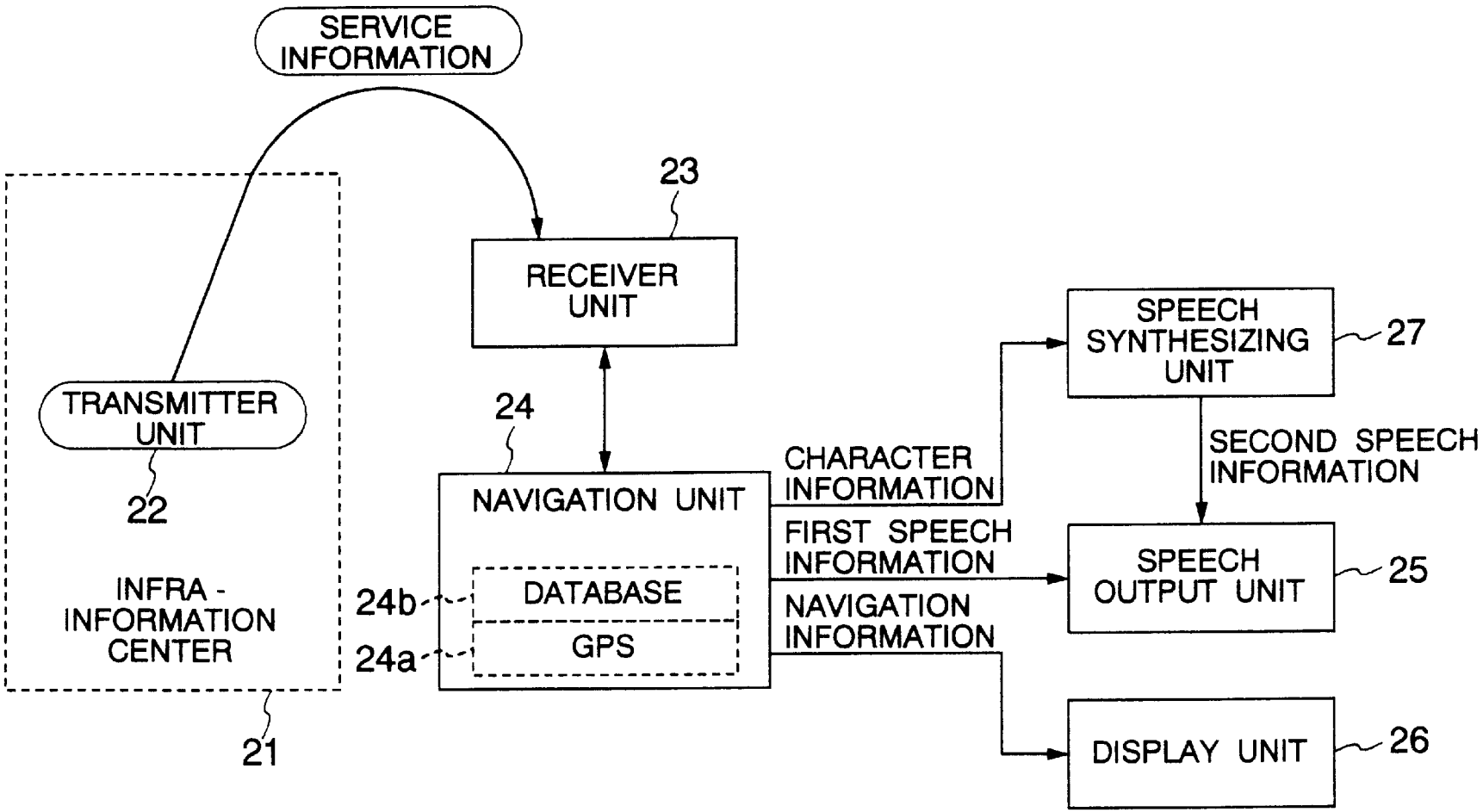
FIG. 2 is a block diagram showing a configuration of a multiplexed-information receiving apparatus according to a second embodiment of the invention.

FIG. 2 is a block diagram showing generally a circuit arrangement of the multiplexed-information receiving apparatus according to a second embodiment of the present invention which is applied to a navigation system capable of utilizing a system which delivers various information such as road traffic information or the like to mobiles such as motor vehicles. More specifically, it is assumed that the multiplexed-information receiving apparatus according to the instant embodiment of the invention is applied to a navigation system which is compatible with a system known as the VICS mentioned hereinbefore. The character-multiplexed information signal and the picture information signal sent out from a VICS center as the service information may contain information concerning traffic congestion, music information, weather information, topological information (indicative of place names, road names, intersection names, etc.), traffic obstruction information, simplified graphic information, parking zone information, map information and/or the like.

In FIG. 2, reference numeral 21 denotes an infra-information center including a transmitter unit 22 for sending out various service information such as road traffic information and others such as mentioned above, and 23 denotes a receiver unit for receiving the service information from the infra-information center 21. Further, reference numeral 24 denotes a navigation unit for generating navigation information. To this end, the navigation unit 24 incorporates a GPS (Global Positioning System) 24*a* for deriving position or location information and a database 24*b* storing map information and others and serves for processing the service information in association with the position information and the map information. Furthermore, reference numeral 25 denotes a speech output unit for outputting a speech information in a voice signal, 26 denotes a display unit for displaying in an image the navigation information derived through the processing executed by the navigation unit 24, and finally a numeral 27 denotes a speech synthesizing unit for transforming or converting the character information outputted from the navigation unit 24 into speech information.

The navigation system according to the instant embodiment of the invention may include a GPS (Global Positioning System) for determining the current position or location of an object such as a mobile (e.g. motor vehicle) equipped with the navigation system now under consideration. Further, as the recording medium for storing the map information, there may be employed a CD-ROM (Compact Disk-Read Only Memory). Furthermore, as the device for the display unit 26, there may be conceived a LCD (Liquid Crystal Display).

Now, description will be directed to operation of the navigation system implemented in the configuration shown in FIG. 2.

Referring to FIG. 2, the service information broadcast from the infra-information center 21 by way of the transmitter unit 22 is received by the receiver unit 23 of the navigation system. Then, the service information as received is sent from the receiving unit 23 to the navigation unit 24. When the service information contains the character-multiplexed information, the navigation unit 24 separates or demultiplexes the character-multiplexed information into speech information and character information which is represented by digital signal. On the other hand, the navigation unit 24 serves for generating the other service information than the speech information on the basis of the position or location information derived from the GPS 24*a* and the map information read out from the database 24*b* in correspondence to the information display modes which can be validated in the VIC system At this juncture, the information display modes of the VIC system will be elucidated. In the VIC system, there exist a plurality of information display modes including typically a character display mode, a simplified graphic display mode and a map display mode. By way of example, in the character display mode, the character information contained in the service information is presented in a simplified character string (e.g. in the form of two rows each composed of fifteen character) on the screen of the display unit 26. In the simplified graphic display mode, simple graphics such as so-called illust. are generated on the basis of the character information and the graphic information contained in the service information to be displayed on the screen of the display unit 26. Finally, in the map display mode, the service information received by the receiver unit 23 is displayed in superposition onto a map generated on the basis of the map information stored in the database 24*b* and displayed on the screen of the display unit 26.

The navigation information generated compatibly with the information display mode mentioned above is sent to the display unit 26 to be displayed on the screen thereof. Furthermore, when the speech information and the character information are contained in the service information received by the receiver unit 23, the character information is sent to the speech synthesizing unit 27, while the speech information is sent to the speech output unit 25 from the navigation unit 24, respectively. The speech synthesizing unit 27 serves to covert the character information into speech information to output the latter to the speech output unit 25. The speech output unit 25 is capable of outputting in the form of speech the first speech information sent from the navigation unit 24 and the second speech information sent from the speech synthesizing unit 27, respectively.

Although the multiplexed-information receiving apparatus according to the instant embodiment of the invention has been described on the assumption that it is applied to the navigation system compatible with the system known as the VIC system, it should be appreciated that the invention is never restricted to such application but can find other various applications within the skill of those persons having ordinary knowledge in the art.

As can be seen from the above, in the multiplexed-information receiving apparatus according to the instant embodiment of the invention, the character information contained in the service information signal received by the receiver unit 23 is not only displayed on the display unit 26 but also converted into the speech information by the speech synthesizing unit 27 to be subsequently outputted in the form of a voice signal from the speech output unit 25. Thus, an operation of the apparatus such as a driver operating a motor vehicle equipped with the navigation system incorporating the multiplexed-information receiving apparatus can aurally understand the content of the character information without being forced to pay attention only to the information displayed on the display unit 26.

EMBODIMENT 3

Next, a third embodiment of the present invention will be described by reference to the drawings. Parenthetically, description concerning the parts or arrangements which are same as or similar to those described hereinbefore will be simplified or omitted.

Figure 3:
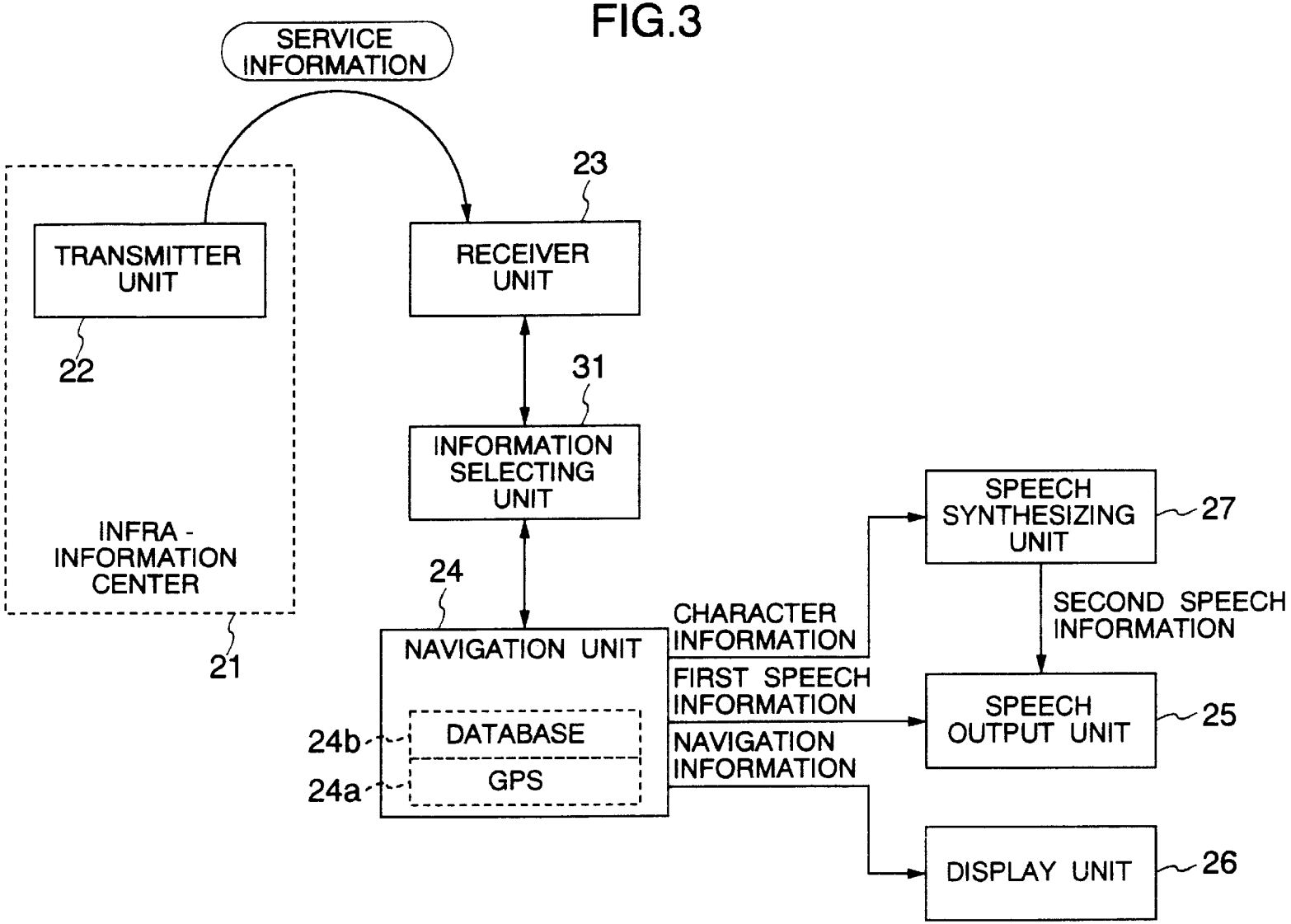
FIG. 3 is a block diagram showing a configuration of a multiplexed-information receiving apparatus according to a third embodiment of the invention.

FIG. 3 is a block diagram showing a structure of multiplexed-information receiving apparatus according to the third embodiment of the invention in association with a navigation system which is compatible with what is referred to as the VIC system, as in the case of the apparatus according to the second embodiment of the invention. In FIG. 3, reference numeral 31 denotes an information selecting unit designed for selecting the character information contained in the service information received by the receiver unit 23. Incidentally, like parts as those mentioned previously in conjunction with the second embodiment and serving for the similar functions are denoted by like reference numerals with repetitive description thereof being omitted.

Now, description will be directed to operation of the navigation system implemented in the configuration shown in FIG. 3.

Referring to the figure, the service information broadcast from the infra-information center 21 through the transmitter unit 22 is received by the receiver unit 23 of the navigation system, as in the case of the second embodiment.

The service information as received is then sent from the receiving unit 23 to the information selecting unit 31. The information selecting unit 31 is adapted to select information concerning the character information contained in the service information. By way of example, let's assume that a driver of a motor vehicle desires to obtain only the traffic information. In that case, by setting previously the conditions for enabling the selection of the traffic information at the information selecting unit 31, the information selecting unit 31 then selects only the content of the traffic information from various information contents of the character information contained in the service information, whereupon only the information of the content relating to the traffic information is sent to the navigation unit 24.

On the other hand, the navigation unit 24 generates the navigation information which is required for the navigation and which is compatible with the VICS information display mode (such as character display mode, simplified graphic display mode, map display mode or the like, as mentioned previously in conjunction with the second embodiment) on the basis of the service information sent via the information selecting unit 31 by referencing the position or location information obtained from the global positioning system or GPS 24*a*, map information stored in the database 24*b* and others. The navigation information as generated is displayed on the display unit 26.

Furthermore, the speech information and the character information outputted from the navigation unit 24 are sent to the speech output unit 25 and the speech synthesizing unit 27, respectively, as in the case of the system described previously in conjunction with the second embodiment. Since only the character information concerning the traffic information is selected by the information selecting unit 31, only the character information relating to the traffic information is sent to the speech synthesizing unit 27 which functions to convert the character information into speech information. The speech output unit 25 outputs in a voice signal the first speech information sent from the navigation unit 24 and the second speech information sent from the speech synthesizing unit 27.

As will now be appreciated from the foregoing, in the multiplexed-information receiving apparatus according to the third embodiment of the invention, only the character information demanded by the driver is converted into the speech information by the speech synthesizing unit 27 to be subsequently outputted in the form of speech from the speech output unit 25. Thus, the driver can acquire aurally only the necessary character information while operating the motor vehicle.

EMBODIMENT 4

Next, a fourth embodiment of the present invention will be described below by reference to the drawings. Parenthetically, description concerning the parts or arrangements which are same as or similar to those described hereinbefore will be simplified or omitted.

Figure 4:
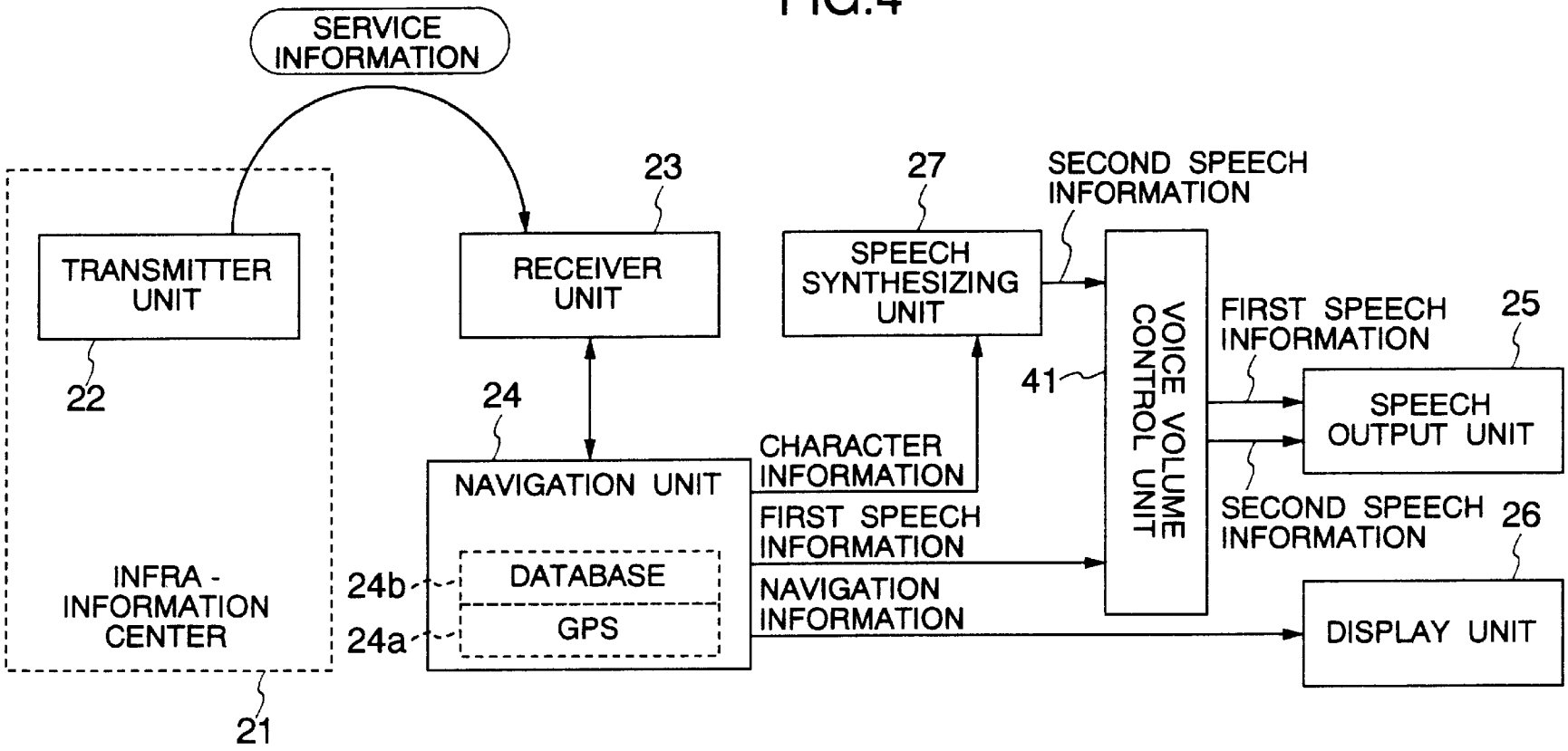
FIG. 4 is a block diagram showing a configuration of a multiplexed-information receiving apparatus according to a fourth embodiment of the invention.

FIG. 4 is a block diagram showing a structure of multiplexed-information receiving apparatus according to the fourth embodiment of the invention, which apparatus is incorporated in a navigation system compatible with the VICS, as in the case of the apparatus according to the second embodiment of the invention. In FIG. 4, reference numeral 41 denotes a voice volume control unit for controlling or adjusting volume levels of the first speech information contained in the service information and the second speech information converted from the character information by the speech synthesizing unit 27. In addition, like parts as those described in the second embodiment and serving for the same functions are denoted by like reference numerals with repetitive description thereof being omitted.

Now, description will be directed to operation of the navigation system implemented in the configuration shown in FIG. 4.

Referring to FIG. 4, the service information broadcast from the infra-information center 21 through the transmitter unit 22 is received by the receiver unit 23, as in the case of the second embodiment. The service information as received is then sent to the navigation unit 24. On the other hand, the navigation unit 24 generates the navigation information required for the navigation and compatible with the VICS information display mode (such as character display mode, simplified graphic display mode, map display mode or the like mentioned previously in conjunction with the second embodiment) on the basis of the service information by referencing the position or location information, map information or the like. The navigation information as generated is displayed on the display unit 26.

Furthermore, the character information outputted from the navigation unit 24 is sent to the speech synthesizing unit 27, while the speech information are sent to the voice volume control unit 41. The speech information obtained after conversion of the character information by the speech synthesizing unit 27 is sent to the voice volume control unit 41.

At this juncture, it should be mentioned that the voice volume control unit 41 identifies discriminatively the speech information sent from the navigation unit 24 as the first speech information while identifying as a second speech information the speech information coming from the speech synthesizing unit 27. For realizing the discrimination of the first speech information and the second speech information from each other, the voice volume control unit 41 is so designed as to perform control of a voice volume level when the speech information is outputted to the speech output unit 25. By way of example, in case the second speech information is additionally inputted in the state where only the first speech information is being inputted, the voice volume control unit 41 then controls the voice volume level of the second speech information so that it becomes higher. This can be accomplished by designing the voice volume control unit 41 such that when the second speech information is outputted to the speech output unit 25, the former can be generated at a higher level than the voice volume level at which the first speech information is outputted from the speech output unit 25 in an automatic manner without the need for intervention of the operator or driver for adjusting the voice volume level of the speech output unit 25.

In this way, even when the first speech information and the second speech information are outputted in a mixed state, the voice volume level of the second speech information derived from the conversion of the character information is controlled to become higher than the volume level of the first speech information. Thus, the operator or driver can understand the content of the character information in the form of speech information without fail.

EMBODIMENT 5

Next, a fifth embodiment of the present invention will be described below by reference to the drawings. Parenthetically, description concerning the parts or arrangements which are same as or similar to those described hereinbefore will be simplified or omitted.

Figure 5:
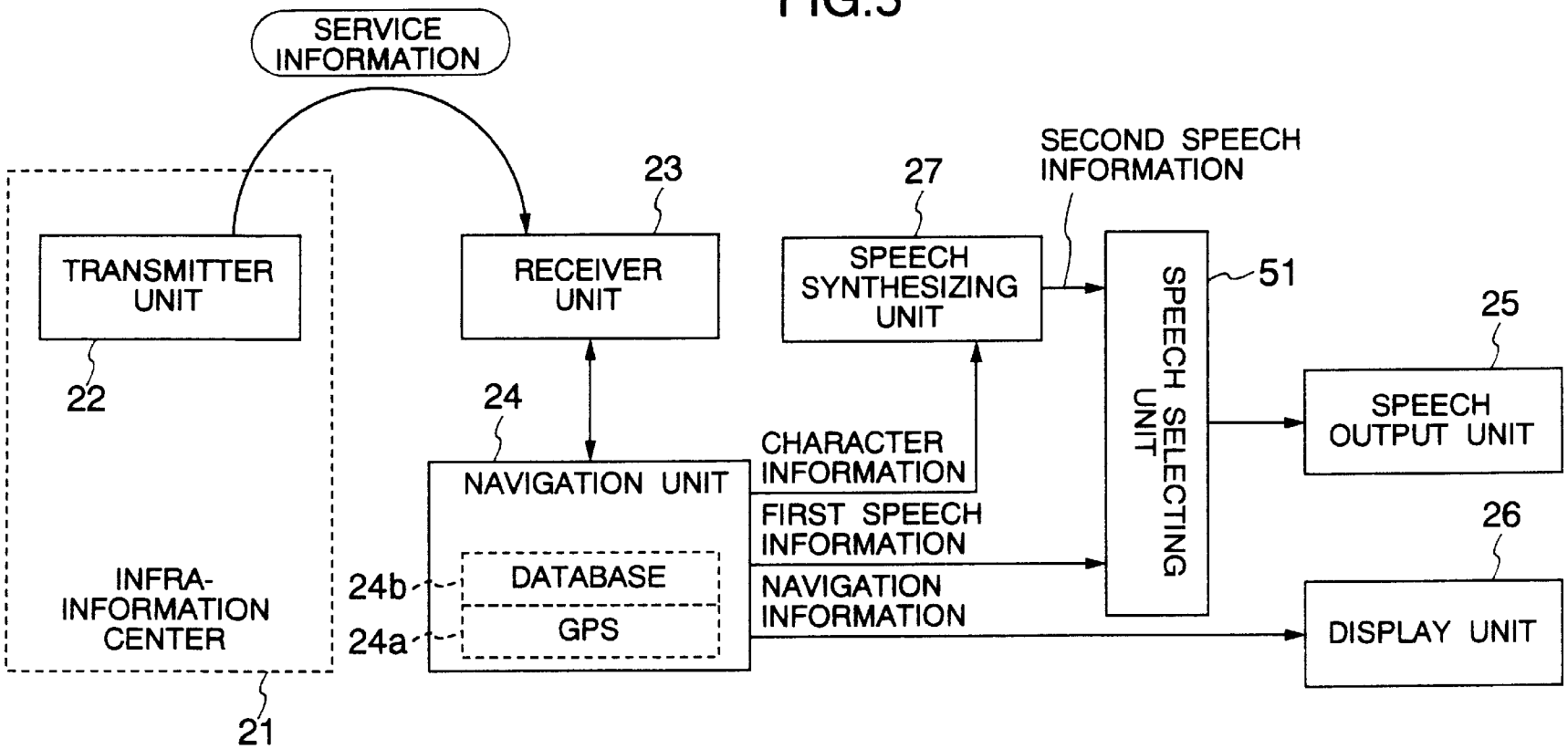
FIG. 5 is a block diagram showing a configuration of a multiplexed-information receiving apparatus according to a fifth embodiment of the invention.

FIG. 5 is a block diagram showing a structure of multiplexed-information receiving apparatus according to the fifth embodiment of the invention which apparatus is incorporated in a navigation system compatible with the VICS, as in the case of the apparatus according to the second embodiment of the invention. In FIG. 5, reference numeral 51 denotes a speech selecting unit designed for selecting either the first speech information contained in the service information or the second speech information which results from the conversion of the character information by the speech synthesizing unit 27. Incidentally, like parts as those described previously in conjunction with the second embodiment and serving for the same functions are denoted by like reference numerals with repetitive description thereof being omitted.

Next, operation of the navigation system implemented in the configuration shown in FIG. 5 will be elucidated below.

Referring to FIG. 5, the service information broadcast from the infra-information center 21 through the transmitter unit 22 is received by the receiver unit 23, as in the case of the second embodiment. The service information as received is then sent to the navigation unit 24, which generates the navigation information required for the navigation and compatible with the VICS information display mode (such as character display mode, simplified graphic display mode, map display mode or the like illustrated previously in conjunction with the second embodiment) on the basis of the service information by referencing the position or location information, map information or the like. The navigation information as generated is displayed on the display unit 26.

Furthermore, the character information outputted from the navigation unit 24 is sent to the speech synthesizing unit 27, while the speech information is sent to the speech selecting unit 51. The speech selecting unit 51 is so arranged as to output to the speech output unit 25 selectively either the first speech information sent from the navigation unit 24 or the second speech information coming from the speech synthesizing unit 27. By way of example, in case the second speech information is additionally inputted to the speech selecting unit 51 from the speech synthesizing unit 27 in the state in which only the first speech information sent from the navigation unit 24 is being inputted to the speech selecting unit 51, the first speech information is inhibited from being outputted during the second speech information is generated, in order to furnish the operator or user with the second speech information without fail.

EMBODIMENT 6

Next, a sixth embodiment of the present invention will be described below by reference to the drawings. Parenthetically, description concerning the parts or arrangements which are same as or similar to those described hereinbefore will be simplified or omitted.

Figure 6:
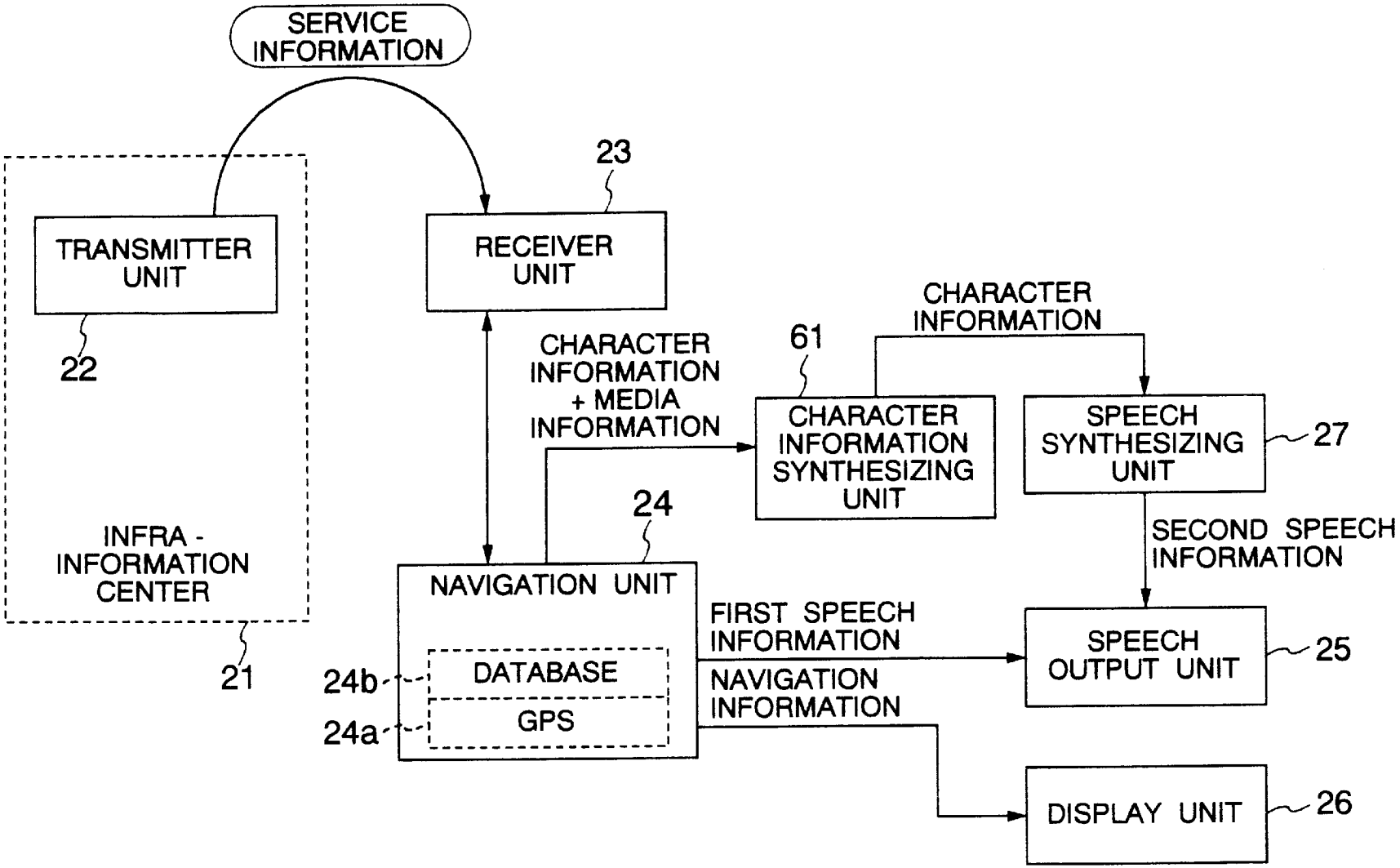
FIG. 6 is a block diagram showing a configuration of a multiplexed-information receiving apparatus according to a sixth embodiment of the invention.

FIG. 6 is a block diagram showing a structure of multiplexed-information receiving apparatus according to the sixth embodiment of the invention, which apparatus is incorporated in a navigation system compatible with the VIC system, as in the case of the apparatus according to the second embodiment of the invention. In FIG. 6, reference numeral 61 denotes a character information synthesizing unit designed for converting into character information the service information received by the receiver unit 23 except for the speech information and the character information (hereinafter the service information exclusive of the speech and character information as mentioned above will be referred to as the media information).

Now, description will be directed to operation of the navigation system implemented in the configuration shown in FIG. 6.

Referring to the figure, the service information broadcast from the infra-information center 21 by the transmitter unit 22 is received by the receiver unit 23, as in the case of the second embodiment. The service information as received is then sent to the navigation unit 24. On the other hand, the navigation unit 24 generates the navigation information required for the navigation and compatible with the VICS information display mode (such as character display mode, simplified graphic display mode, map display mode or the like illustrated previously in conjunction with the second embodiment) on the basis of the service information by referencing the position or location information, map information or the like. The navigation information as generated is displayed on the display unit 26.

The speech information outputted from the navigation unit 24 is sent to the speech output unit 25 as the first speech information to be outputted in a voice signal. On the other hand, the character information and the media information are sent to the character information synthesizing unit 61 which is so arranged as to allow the character information to pass therethrough as it is while synthesizing the media information into character information to be subsequently outputted. By way of example, in the case where information concerning traffic congestion at an intersection is received, the character information synthesizing unit 61 generates by synthesization the speech information having the content coinciding with the information messaging the traffic congestion or derives speech information by reading out a corresponding synthesized statement stored previously in a memory or storage. The character information outputted from the character information synthesizing unit 61 is converted into voice or speech information by the speech synthesizing unit 27 to be outputted as the second speech information in a voice signal from the speech output unit 25.

EMBODIMENT 7

Next, a seventh embodiment of the present invention will be described below by reference to the drawings. Parenthetically, description concerning the parts or arrangements which are same as or similar to those described hereinbefore will be simplified or omitted.

Figure 7:
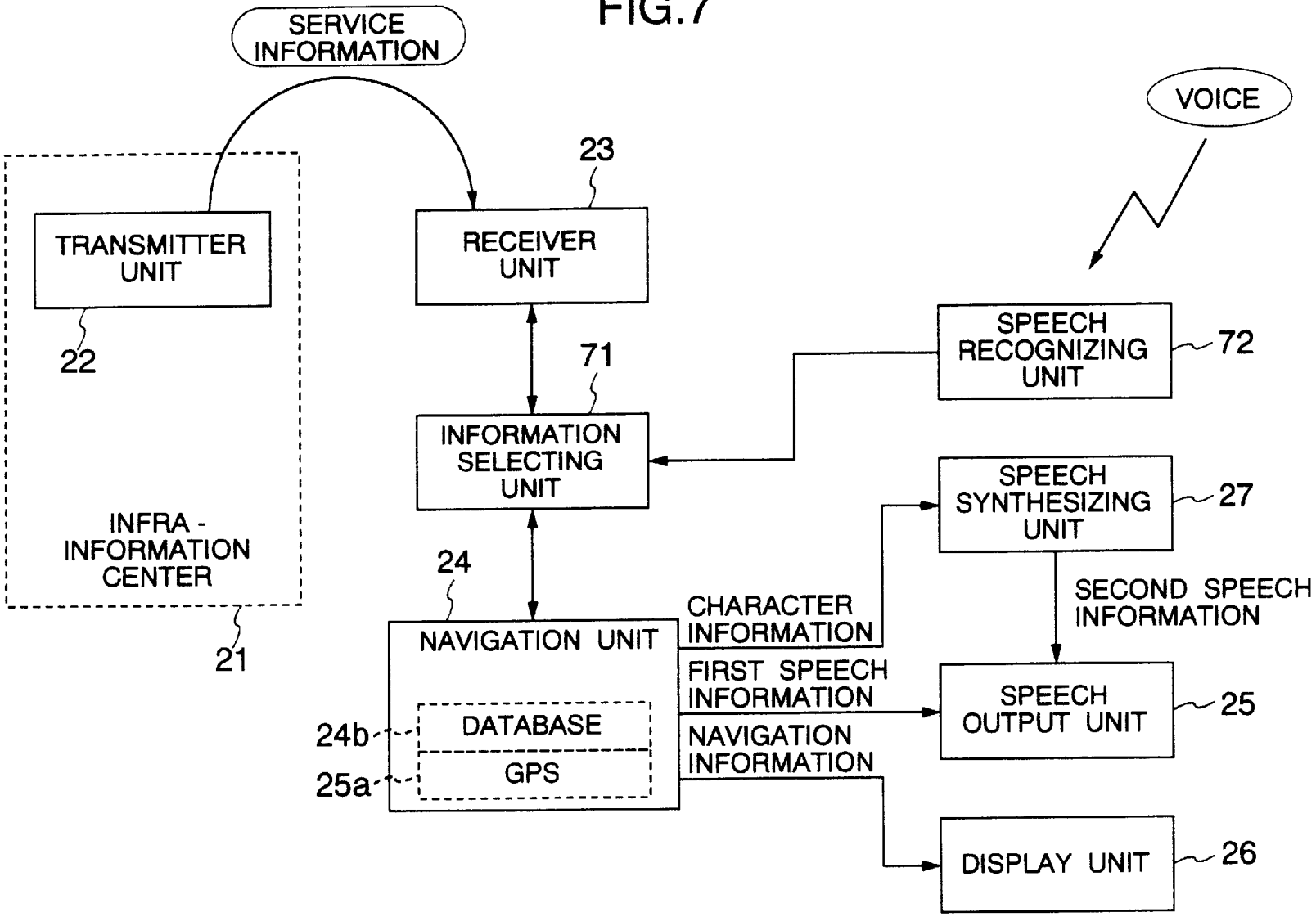
FIG. 7 is a block diagram showing a configuration of a multiplexed-information receiving apparatus according to a seventh embodiment of the invention.
Figure 8:
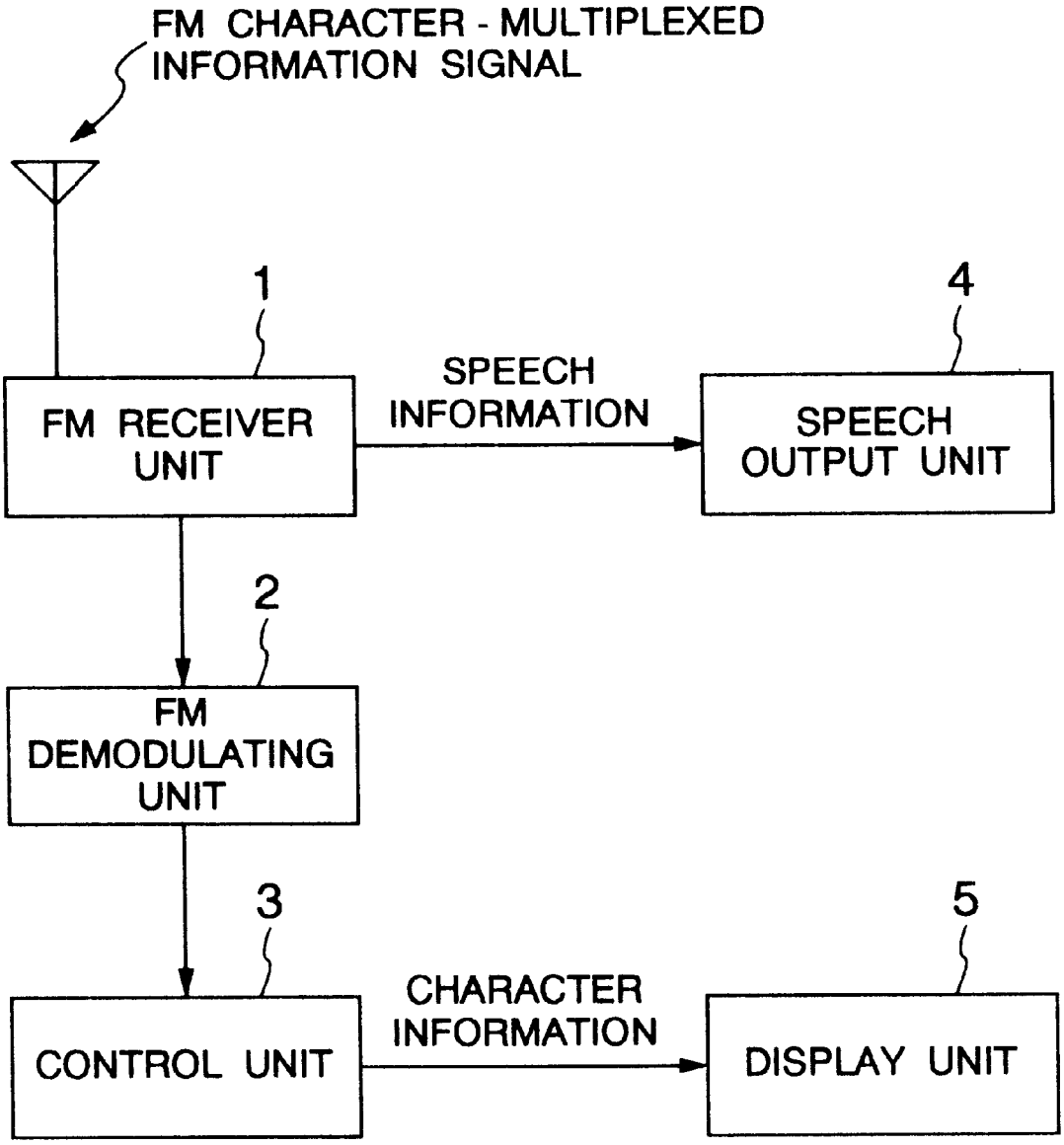
FIG.8 PRIOR ART
FIG. 8 is a block diagram showing a configuration of a conventional multiplexed-information receiving apparatus known heretofore.
Figure 9:
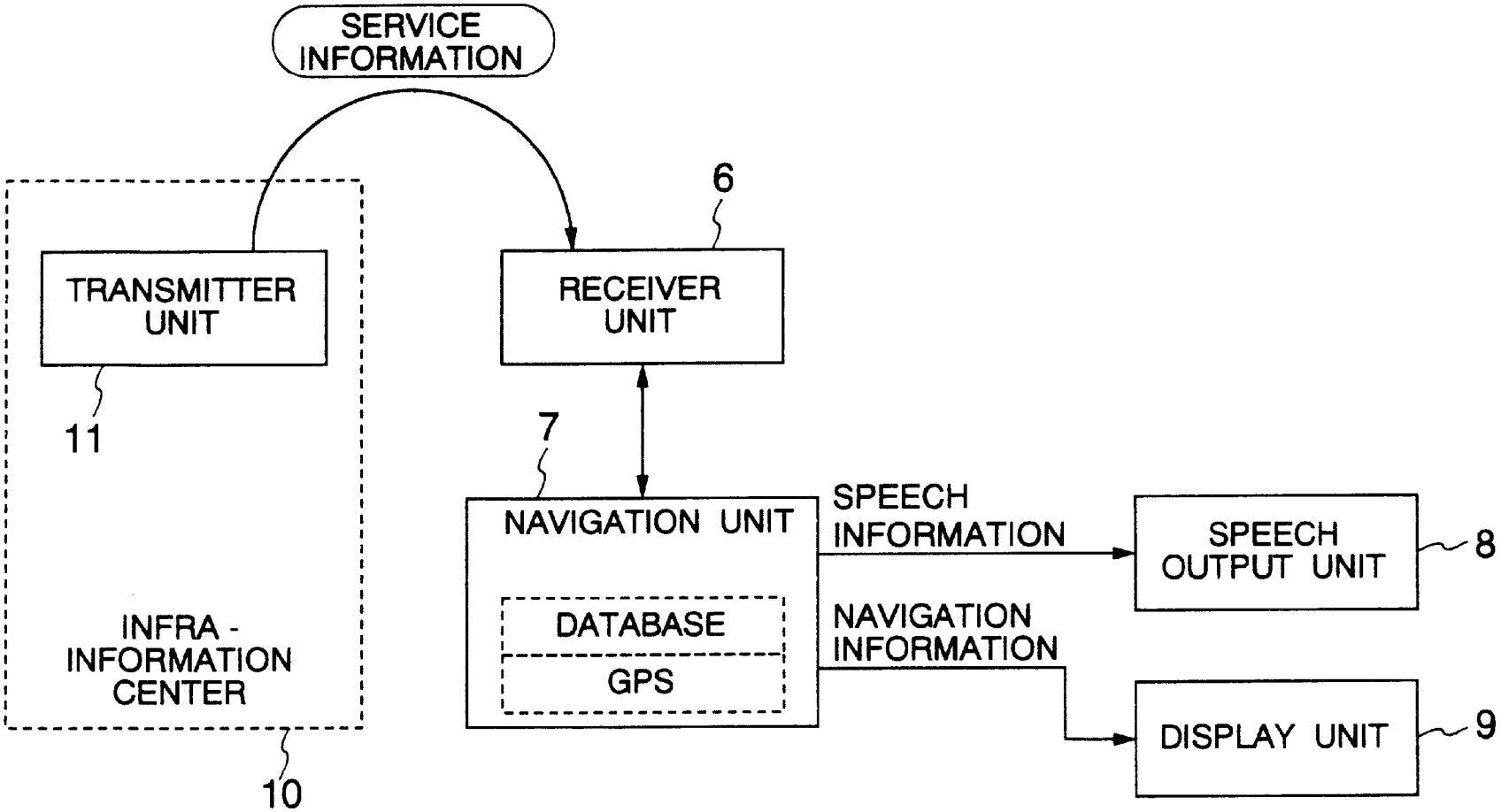
FIG.9 PRIOR ART
FIG. 9 is a block diagram showing a configuration of the vehicle information and transport system in which a conventional multiplexed-information receiving apparatus known heretofore is employed.

FIG. 7 is a block diagram showing a structure of multiplexed-information receiving apparatus according to the seventh embodiment of the invention incorporated in a navigation system which is compatible with the so-called VICS, as in the case of the apparatus according to the second embodiment of the invention. In FIG. 7, reference numeral 71 denotes an information selecting unit designed for selecting character information contained in service information received by the receiver unit 23, and 72 denotes a speech recognizing unit designed for recognizing a request or command inputted by a driver or operator in the form of a speech (or in a voice signal).

Now, description will turn to operation of the navigation system implemented in the configuration shown in FIG. 7.

Referring to the figure, the service information broadcast from the infra-information center 21 through the transmitter unit 22 is received by the receiver unit 23, as in the case of a second embodiment.

The service information as received is then sent to the information selecting unit 71. As for the character information, the information selecting unit 71 is implemented such that only the character information having the content designated by the speech recognizing unit 72 is sent to the navigation unit 24. By way of example, when the driver wants to know only the road traffic information, then he or she can input a corresponding command in a voice as the condition for selecting the road traffic information. Then, the content of the voice command inputted by the driver is recognized by the speech recognizing unit 72, whereupon the information selecting unit 71 is so set that the road traffic information commanded by the driver is selected while inhibiting the other character information than the road traffic information from being conveyed to the navigation unit 24.

Thus, navigation unit 24 receives only the character information concerning the road traffic information from the information selecting unit 71 and processes the character information in such a manner as described previously in conjunction with the second embodiment, whereby navigation information is outputted onto the display unit 26 while the first speech information and the second speech information resulting from conversion of the character information are outputted to the speech output unit 25.

Many modifications and variations of the present invention are possible in the light of the above techniques. By way of example, although the invention has been described in conjunction with a VIC-compatible navigation system for a motor vehicle, the invention is never restricted to such application but can find many other applications within the skill of those having ordinary knowledge in this field. It is therefore to be understood that within the scope of the appended claims, the invention may be practiced otherwise than as specifically described.

What is claimed is:

1. A navigation system, comprising:

(a) a multiplexed-information receiving apparatus comprising:

receiving means for receiving multiplexed information including (i) character information concerning a road traffic state to be displayed in said navigation system and (ii) first speech information;

demultiplexing means for demultiplexing said multiplexed information received by said receiving means to separate and output the first speech information and the character information;

speech synthesizing means for converting the character information outputted from said demultiplexing means into second speech information;

speech output means for outputting the first speech information and said second speech information in a voice signal; and voice volume control means for controlling voice volume of the first speech information and the second speech information, wherein said voice volume control means controls said first speech information and said second speech information so that they are output to said speech output means with respective voice volume levels differing from each other;

(b) system position determining means for determining a system position at which said navigation system is currently located;

(c) storage means for storing map information; and (d) display means for providing a display of the system position determined by said system position determining means together with said map information so that said system position is contained within said map information in said display, and wherein said display means displays additionally the character information outputted from said demultiplexing means.

2. A navigation system according to claim 1, further comprising speech information selecting means for selecting either one of said first speech information or said second speech information to be outputted to said speech output means.

* * * * *